US006405486B1

(12) United States Patent
Rogers, Jr. et al.

(10) Patent No.: US 6,405,486 B1
(45) Date of Patent: Jun. 18, 2002

(54) VEHICLE LIFTGATE POWER OPERATING SYSTEM

(75) Inventors: Lloyd Walker Rogers, Jr., Shelby Township; David Joseph Chapman, Sterling Heights; Brian Norman Orr, Chesterfield; Joseph Michael Johnson, Huntington Woods, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/704,120

(22) Filed: Nov. 1, 2000

(51) Int. Cl.[7] ..... E05F 11/24

(52) U.S. Cl. ..... 49/339; 49/340; 296/146.8; 296/146.1; 296/56

(58) Field of Search ..... 49/339, 340, 341, 49/325; 296/56, 146.8

(56) References Cited

U.S. PATENT DOCUMENTS

| | | | | |
|---|---|---|---|---|
| 3,343,303 A | * | 9/1967 | Wanlass | |
| 4,165,583 A | | 8/1979 | Meyer | |
| 4,541,293 A | | 9/1985 | Caugant et al. | |
| 4,850,140 A | | 7/1989 | Compeau et al. | |
| 5,209,057 A | | 5/1993 | Remlaoui | |
| 5,271,182 A | * | 12/1993 | Greisner et al. | 49/325 |
| 5,448,856 A | | 9/1995 | Moore et al. | |
| 5,563,483 A | | 10/1996 | Kowall et al. | |
| 5,802,768 A | * | 9/1998 | Hammer et al. | 49/325 |
| 5,851,050 A | | 12/1998 | Squire et al. | |
| 5,921,611 A | | 7/1999 | Townsend | |
| 6,055,775 A | * | 5/2000 | Dering et al. | 49/340 |
| 6,055,776 A | * | 5/2000 | Dettling et al. | 49/341 |
| 6,092,337 A | | 7/2000 | Johnson et al. | |
| 6,137,249 A | * | 10/2000 | Butler et al. | 318/266 |
| 6,142,551 A | * | 11/2000 | Ciavaglia et al. | 296/56 |
| 6,283,535 B1 | * | 9/2001 | Yuge | 296/146.8 |

* cited by examiner

*Primary Examiner*—Curtis Cohen
(74) *Attorney, Agent, or Firm*—Patrick M. Griffin

(57) ABSTRACT

A power operating system for opening and closing a vehicle liftgate has a pair of drive units supported on the vehicle roof and connected to the liftgate for opening and closing the liftgate. Each drive unit includes a bracket that is secured to the vehicle body for supporting several parts including a reversible electric motor, a gear unit and a track. The electric motor drives a segmented drive linkage inside the track via a gear reduction unit and a sprocket. The segmented drive linkage includes an elongated arcuate link arm that slides in an arcuate track portion of the track and a power roller chain that is stored in a storage track portion when the liftgate is closed. The outboard end of the link arm is pivotally connected to the liftgate to open and close the liftgate as the link arm is extended and retracted by the power roller chain.

10 Claims, 2 Drawing Sheets

VEHICLE LIFTGATE POWER OPERATING SYSTEM

TECHNICAL FIELD

This invention relates to a power operating system for a vehicle liftgate that is pivotally attached to a vehicle compartment for pivotal movement about a generally horizontal hinge axis and more particularly to a power operating system that will move a liftgate from a closed position to a fully open position and from an open position to a fully closed position.

BACKGROUND OF THE INVENTION

Utility vehicles and vans with liftgates that are hinged at the top about a generally horizontal axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power operating system for opening and closing the liftgate.

A number of different liftgate openers have been tried in recent years. Some of these liftgate openers have a single cable that opens and closes a liftgate in connection with a counterbalance system, such as a gas spring counterbalance system. Liftgates with a single cable opener and closer are generally trunk lids that are lightweight and have a relatively small range of movement.

Gas spring output varies with temperature. This complicates power liftgate systems that rely on gas springs to open the liftgate. The gas spring or springs must be strong enough to open the liftgate on the coldest day (−40° C.). This results in gas springs that increase closing resistance substantially on the hottest day (80° C.). Therefore a very large electric motor must be used to close the liftgate.

Liftgates that have two or more gas springs for a counter balance system are common. These gas springs generally occupy a position in which their axis is substantially parallel to the liftgate so that the gas springs are hidden when the liftgate is closed. In this closed position the moment arm of the gas springs is quite small. With such systems the lift gate may move about one-third of their total travel range before the gas cylinders exert sufficient force to open a liftgate further without the application of an independent lifting force. There are even some systems in which the gas springs pass over center and bias a liftgate toward a closed position when the liftgate is closed. With these self-closing systems a liftgate may need to be more than one-third open before the gas springs will open the liftgate further.

The force required to hold a liftgate in a given position along its path of movement from a closed position to a fully open position varies substantially in some liftgate opening systems. A power liftgate closer must exert sufficient force to hold a liftgate in any given position along the path of movement, plus the force to overcome friction, and plus the force required to accelerate the liftgate during liftgate closing. If the total force exerted by the liftgate power closure varies substantially from one position between fully opened and closed to another position between fully opened and closed, it may be difficult for the control system to detect an obstruction and stop the liftgate without incurring damage to the vehicle or to the object that obstructs the liftgate.

SUMMARY OF THE INVENTION

The object of the invention is to provide an improved vehicle liftgate power operating system.

A feature of the invention is that the vehicle liftgate power operating system can move the liftgate from a closed position to a fully opened position as well as from an open position to a fully closed position.

Another feature of the invention is that the liftgate power operating system allows the liftgate to be moved manually when an efficient gear train is selected.

Another feature of the invention is that power operating system can be stopped at any point to hold the liftgate in any intermediate position without any need for a brake, detent or the like.

Still another feature of the invention is that the drive unit of the liftgate power operating system has a segmented drive linkage attached to the liftgate that is guided by a track that is preferably shaped to hug the interior roof structure and thus minimize intrusion into the cargo area of the vehicle and maximize the unobstructed load height at the liftgate opening.

Yet another feature of the invention is that the liftgate power operating system preferably has a moveable link arm attached to the liftgate that is preferably shaped and guided to move concentrically with respect to the hinge axis of the liftgate so that the moveable link arm can be sealed easily and/or located exit outside the liftgate perimeter seal.

Still yet another feature of the invention is that the liftgate power operating system has a flexible drive member, preferably a power roller chain that is routed in a track of desired shape easily.

Still yet another feature of the invention is that the power operating system can be used in conjunction with a counterbalance system.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 2:
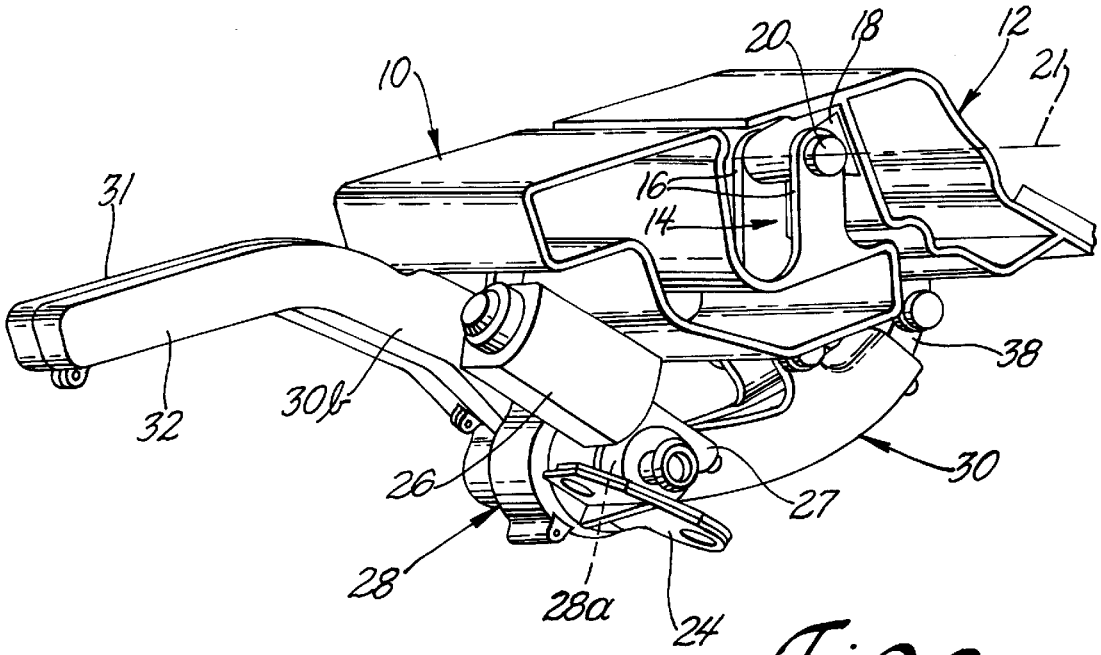
FIG. 2 is an enlarged perspective view of the right hand drive unit of the power operating system of FIG. 1 showing the drive unit when the liftgate is closed.
Figure 3:
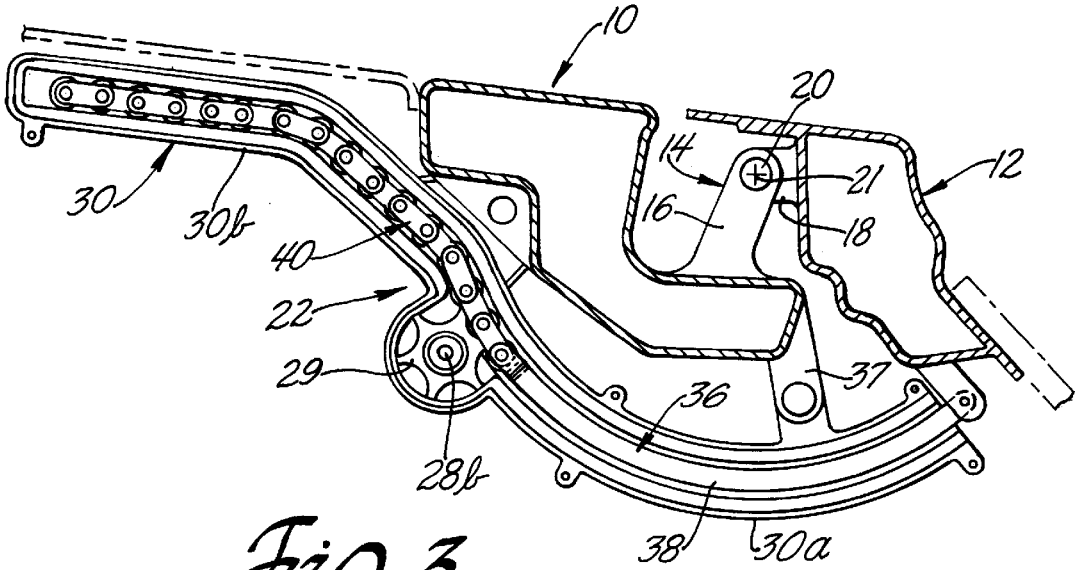
FIG. 3 is an enlarged side view of the right hand drive unit shown in FIG. 2 with parts removed to show internal detail.
Figure 4:
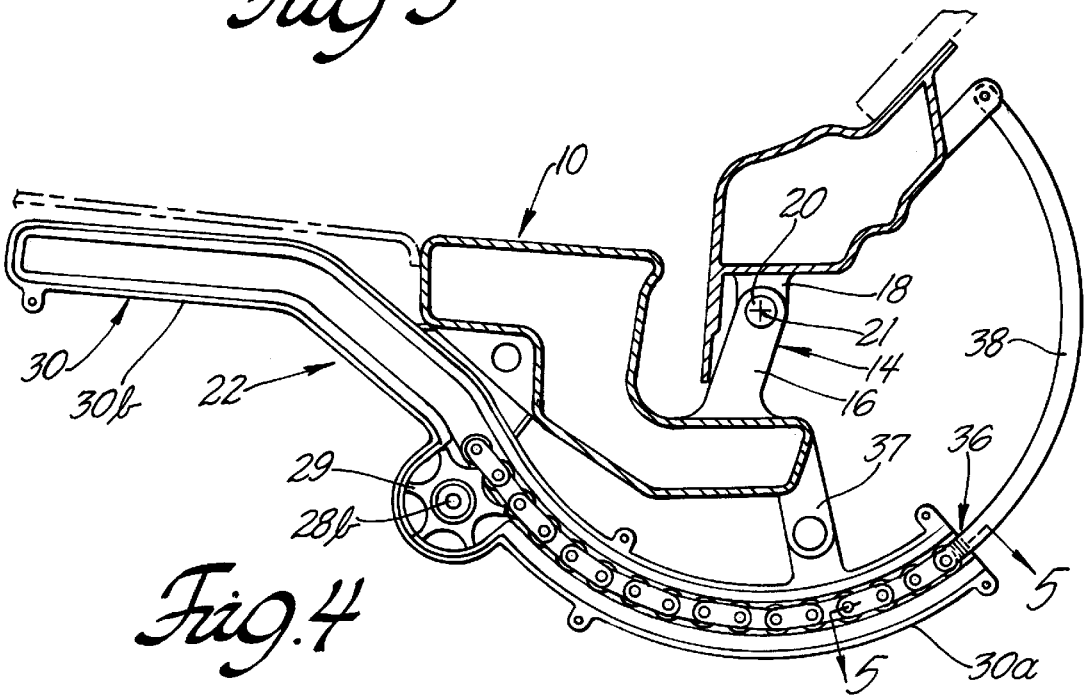
FIG. 4 is an enlarged side view of the right hand drive unit shown in FIG. 2 with parts removed to show internal detail when the liftgate is in the open position.

Referring now to the drawings, vehicle 10 has a liftgate 12 that is attached to the aft end of the vehicle roof by two hinge assemblies. The typical right hand hinge assembly 14 is shown in FIGS. 2, 3 and 4.

Figure 1:
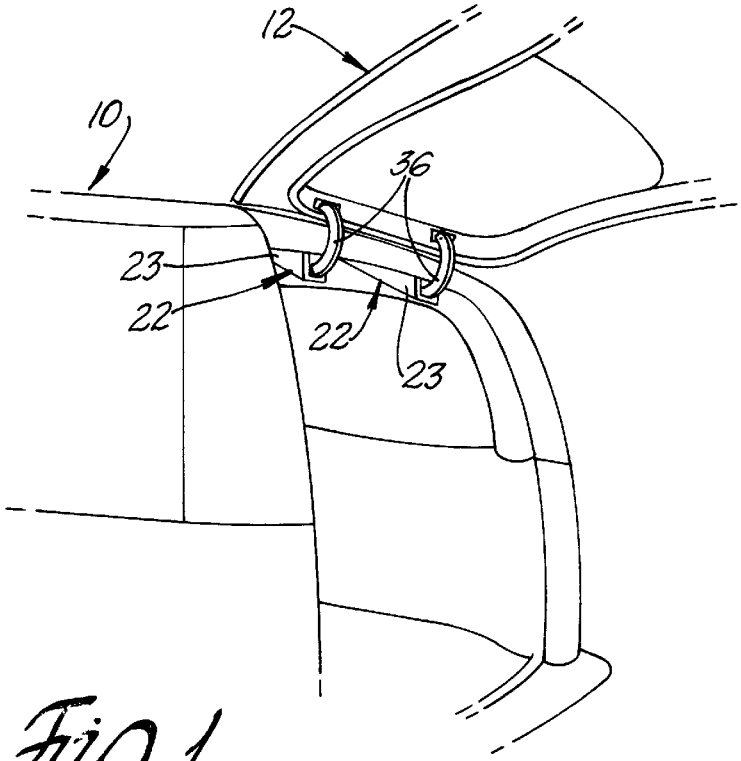
FIG. 1 is a perspective view of the rear portion of a vehicle equipped with a liftgate power operating system of the invention showing the liftgate in an open position.

Hinge assemblies 14 have hinge portions 16 that are secured to a roof channel of the vehicle 10 and hinge portions 18 that are secured to a top channel the liftgate 12. Hinge portions 18 are attached to hinge portions 16 by pivot pins 20 so that liftgate 12 pivots about a hinge axis indicated at 21 in FIGS. 2, 3 and 4 from a closed position shown in FIGS. 2 and 3 to a raised open position shown in FIGS. 1 and 4. Hinge axis 21 is generally substantially horizontal and liftgate 12 is generally permitted to pivot about 90° about hinge axis 21. However, the range of movement can be varied substantially from one vehicle 10 to another.

Lift gate 12 is opened and closed by a power operating system that includes two identical drive units 22 that are installed in the aft end of the vehicle roof. Drive units 22 are laterally spaced from each other and near the respective vertical body pillars at the aft end of vehicle 10 that define the rear opening that is closed by lift gate 12. The typical drive unit 22 is shown in FIGS. 2, 3 and 4 with the interior trim cover 23 removed to show detail of the drive unit.

Each drive unit 22 comprises a bracket 24 that is secured to the vehicle body in a fixed position for supporting several parts including a reversible electric motor 26, a gear reduction unit 28, and a two piece track 30 comprising a track base 31 and a track cover 32. Electric motor 26 has a worm gear output 27 that drives a pinion gear 28*a* of the gear reduction unit 28. Pinion gear 28*a* drives sprocket 29 via internal gears and a splined stub shaft 28*b* to provide speed reduction and torque multiplication.

The two piece track 30 includes a rearward track portion 30*a* and a contiguous forward track portion 30*b* that are secured to the vehicle body in a fixed position. Bracket 24 attaches the inboard end of rearward track portion 30*a* via the housing for gear unit 28 while hanger 37 attaches the aft end of track 30.

Rearward track portion 30*a* is preferably shaped to hug the aft end of the vehicle roof, particularly the box beam that carries the hinge portions 16 as best shown in FIGS. 2, 3 and 4, in order to maximize unobstructed load height at the liftgate opening. Track portion 30*a* is also preferably arcuately shaped with a radius of curvature that is centered on the hinge axis 21 of lift gate 12. Forward track portion 30*b* preferably is above the arcurate rearward tract portion 30*a* and turns in an opposite direction resulting in a wave-like configuration for track 30 that follows the interior contour of the vehicle roof closely. This wave-like configuration and close spacing reduces space requirements and minimizes intrusion into the cargo compartment particularly in the vertical direction.

A segmented drive linkage 36 is disposed in track 30 and moves in track 30 as described below. Segmented drive linkage 36 comprises an elongated link arm 38 and a flexible drive member that conforms to the wave-like configuration of track 30. Flexible drive member is preferably a power roller chain 40 having a plurality of short links that are pivotally connected end-to-end as described in detail below. Link arm 38 is preferably arcuately shaped with a curvature that matches that of rearward track portion 30*a* so that link arm 38 slides back and forth in track portion 30*a* pivoting about hinge axis 21 between the retracted position shown in FIGS. 2 and 3 and the extended position shown in FIGS. 1 and 4. The inboard end of link arm 38 preferably remains in track 30 when lift gate 12 is fully open as shown in FIG. 4. The pivotal movement of link arm 38 about hinge axis 21 eliminates pivotal movement of link arm 38 with respect to liftgate 12 and consequently link arm 38 can be sealed at the vehicle body exit easily. The body exit for link arm 38 can even be placed in the vertical body pillar outside the liftgate perimeter seal (not shown).

Figure 5:
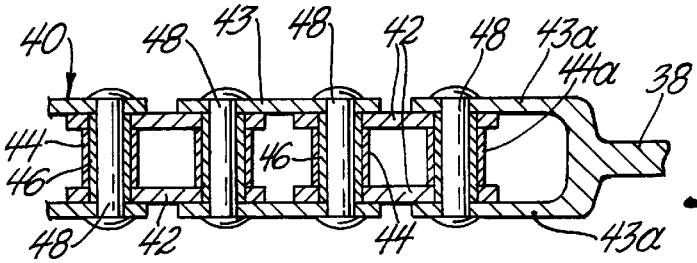
FIG. 5 is a section taken substantially along the line 5—5 of FIG. 4 looking in the direction of the arrows.

Roller chain 40 is stored in forward track portion 36*b* when liftgate 12 is closed as shown in FIG. 3 and then travels into the rearward arcuate portion 30*a* when liftgate 12 is opened as shown in FIG. 4. Roller chain 40 is preferably a power roller chain of modified construction comprising short flat inner and outer link plates 42, 43, rollers 44, bushings 46 and pins 48. As best seen in FIG. 5, each of the rollers 44 rotates on one of the bushings 46 which protrude through holes in inner link plates 42 and space outer link plates 43 apart. Each bushing 46 rotates on one of the pins 48 which retains the overlapping ends of inner and outer link plates 42, 43 on each side of an associated roller 44. The link plates 42, 43 are usually retained by heading or peening the ends of pins 46 but may be retained in any suitable manner that allows the inner and outer link plates 42, 43 on each side of the associated roller 44 to articulate with respect to each other and the roller 44 to roll on the pin 48.

Link plates 42 and 43 are of uniform length and space rollers 44 apart so as to mesh with sprocket 29. Link plates 42, 43 are short and preferably have a height than is less that the diameter of rollers 44 so that the rollers 44 engage upper and lower surfaces of track 30 and space link plates 42 and 43 from these surfaces to facilitate travel of roller chain 40 in the wave-like track 30. Track 30 is preferably made of a plastic having a low coefficient of friction so that the segmented drive linkage 36 slides in track 30 easily.

The inboard end of link arm 38 is bifurcated to provide outer side plates 43*a* for the end roller 44*a* of roller chain 40 so that roller chain 40 is pivotally attached to the inboard end of link arm 38. The outboard end of link arm 38 is pivotally connected to liftgate 12.

The power operating system further includes a conventional power source such as the vehicle battery (not shown) and a suitable motor control for energizing and shutting off the reversible electric motor 26. Motor controls are well known to those skilled in the art and thus need not be described in detail.

The power operating system operates as follows. Assuming that the liftgate 12 is closed as shown in FIGS. 2 and 3, electric motor 26 is energized to open liftgate 12. When energized, electric motor 26 rotates pinion gear 28*a* clockwise. Pinion gear 28*a* in turn rotates output sprocket 29 clockwise driving roller chain 40 toward the aft end of vehicle 10 (toward the right as viewed in FIGS. 2 and 3) until link arm 38 is driven from the retracted position shown in FIGS. 2 and 3 to the extended position shown in FIGS. 1 and 4. This raises liftgate 12 from the closed position shown in FIGS. 2 and 3 to the raised open position shown in FIGS. 1 and 4. When the liftgate 12 is fully opened, a limit switch or the like is actuated to shut off electric motor 26. Liftgate 12 is closed by reversing electric motor 26 so that gear unit 28 drives segmented drive linkage 36 back to the retracted position shown in FIGS. 2 and 3.

With a proper motor control circuit, electric motor 26 can be de-energized at any time in which case liftgate 12 can be stopped at any intermediate position and held in the intermediate position by the friction in gear train 28 without any need for a brake, detent or the like. The liftgate 12 can then be moved by energizing electric motor 26 or the liftgate 12 can then be moved manually because gear train 28 can be designed with sufficient efficiency to permit back drive to electric motor 26.

Sprocket 29 which is located below track 30 in the preferred embodiment can be located above track 30 easily because the spaces between rollers 44 of the preferred power roller chain 40 accept sprocket teeth from either radial direction.

The power operating system can be designed to work alone or in conjunction with gas springs 40 which are well known in the art with the primary adjustment being the size of the electric motor 26.

The power operating system described above preferably includes two identical drive units 22 for balanced operation and reduced manufacturing costs.

However, the drive units need not be identical and in some instances, a single drive unit may be sufficient.

It is also possible to use two drive units with a single reversible electric motor driving both gear trains 28. In such an arrangement the axis of the electric motor is parallel to the axis of the several gears of gear train 28 thereby eliminating the need for a cross axis gear arrangement and possible need for a clutch in order to back drive the electric motor and thus operate the liftgate manually. The same is true with a power operating system having two identical drive units where the axes of the individual electric motors 26 are parallel to the axes of the respective drive trains. In other words, many modifications and variations of the present invention in light of the above teachings may be made. It is, therefore, to be understood that, within the scope of the appended claims, the invention may be practiced otherwise than as specifically described.

We claim:

1. A power operating system for opening and closing a vehicle liftgate that is pivotally attached to an aft end of a vehicle roof for pivotal movement between an open position and a closed position about a hinge axis comprising:

at least one drive unit that includes a reversible electric motor, a track and a segmented drive linkage that is driven by the electric motor and that slides in the track, the segmented drive linkage being adapted for pivotal attachment to a vehicle liftgate at one end for pivotal movement about a first axis that is parallel to the hinge axis, the segmented drive linkage including a flexible drive member at the other end that is driven by the electric motor, and the flexible drive member including plates that articulate with respect to each other about axes that are parallel to the first axis.

2. A power operating system for opening and closing a vehicle liftgate that is pivotally attached to an aft end of a vehicle roof for pivotal movement between an open position and a closed position about a hinge axis comprising:

at least one drive unit that includes a reversible electric motor, a track that has a rearward portion that is arcuately shaped with a radius of curvature that is centered on the hinge axis, and a segmented drive linkage that slides in the track, the segmented drive linkage being adapted for pivotal attachment to a vehicle liftgate at one end for pivotal movement about a first axis that is parallel to the hinge axis, the segmented drive linkage including a power chain at the other end that is driven by a sprocket that is driven by the electric motor, and the flexible drive member including plates that articulate with respect to each other about axes that are parallel to the first axis.

3. The power operating system as defined in claim 2 wherein the track has a wave-like configuration and includes a forward portion for storing at least a portion of the power chain when the liftgate is in the closed position.

4. The power operating system as defined in claim 3 wherein the power chain is a roller chain that includes rollers and side plates, the rollers being sized to engage upper and lower surfaces of the track and the side plates having a height that is less than a diameter of the rollers so that the side plates are spaced from the upper and lower surfaces of the track engaged by the rollers.

5. The power operating system as defined in claim 4 wherein the track is made of a plastic having a low coefficient of friction.

6. A power operating system for opening and closing a vehicle liftgate that is pivotally attached to an aft end of a vehicle roof for pivotal movement between an open position and a closed position about a hinge axis comprising:

at least one drive unit that includes a reversible electric motor, a track of wave-like configuration that has a forward storage portion and a rearward portion that is arcuately shaped with a radius of curvature that is shaped so as to be centered on the hinge axis, and a segmented drive linkage that slides in the track, the segmented drive linkage having an elongated arcuate arm that is adapted to be pivotally attached to the vehicle liftgate at one end for pivotal movement about a first axis that is parallel to the hinge axis, the segmented drive linkage further including a power roller chain that is pivotally attached to the arcuate arm at the other end, the power roller chain having rollers and side plates that rotate about pins that are parallel to the first axis, the power roller chain being driven by a sprocket that is driven by the reversible electric motor, and the forward storage portion storing at least a portion of the power roller chain when the liftgate is in the closed position.

7. The power operating system as defined in claim 6 wherein the elongated arcuate arm has a radius of curvature that matches the radius of curvature of the rearward portion of the track so that the elongated arcuate arm is adapted to pivot about the hinge axis.

8. The power operating system as defined in claim 6 wherein the rollers are sized to engage upper and lower surfaces of the track and the side plates having a height that is less than a diameter of the rollers so that side plates are spaced from the upper and lower surfaces of the track when the rollers engage such surfaces of the track.

9. The power operating system is defined in claim 6 wherein the track is made of a plastic having a low coefficient of friction.

10. A power operating system for opening and closing a vehicle liftgate that is pivotally attached to an aft end of a vehicle roof for pivotal movement between an open position and a closed position about a hinge axis comprising:

at least one drive unit that includes a reversible electric motor, a track of wave-like configuration that has a forward storage portion and a rearward portion that is arcuately shaped with a radius of curvature that is shaped so as to be centered on the hinge axis, and a segmented drive linkage that slides in the track, the segmented drive linkage having an elongated arcuate arm that is adapted to be pivotally attached to the vehicle liftgate at one end for pivotal movement about a first axis that is parallel to the hinge axis, the segmented drive linkage further including a power roller chain that is pivotally attached to the arcuate arm at the other end, the power roller chain having rollers and side plates that rotate about pins that are parallel to the first axis, the power roller chain being driven by a sprocket that is driven by the reversible electric motor, the forward storage portion storing at least a portion of the power roller chain when the liftgate is in the closed position, the rollers being sized to engage upper and lower surfaces of the track and the side plates having a height that is less than a diameter of the rollers so that side plates are spaced from the upper and lower surfaces of the track when the rollers engage such surfaces of the track, and wherein the track is made of a plastic having a low coefficient of friction.

* * * * *